US010921047B2

(12) United States Patent
Kilinc et al.

(10) Patent No.: US 10,921,047 B2
(45) Date of Patent: Feb. 16, 2021

(54) HOME APPLIANCE DEVICE

(71) Applicant: BSH HAUSGERAETE GMBH, Munich (DE)

(72) Inventors: Dogan Kilinc, Istanbul (TR); Korhan Orhan, Tekirdag (TR); Tolga Yegin, Istanbul (TR)

(73) Assignee: BSH Hausgeraete GmbH, Munich (DE)

( * ) Notice: Subject to any disclaimer, the term of this patent is extended or adjusted under 35 U.S.C. 154(b) by 487 days.

(21) Appl. No.: 15/363,029

(22) Filed: Nov. 29, 2016

(65) Prior Publication Data

US 2018/0149405 A1 May 31, 2018

(51) Int. Cl.
*F25D 23/00* (2006.01)
*F25B 13/00* (2006.01)
*F25D 11/02* (2006.01)

(52) U.S. Cl.
CPC ..... *F25D 23/006* (2013.01); *F25B 13/00* (2013.01); *F25D 11/02* (2013.01)

(58) Field of Classification Search
CPC ..... F25D 23/006; F25D 23/067; F25D 2317/0651; F25D 2317/0661; F25D 2323/00264; F25D 2323/00274; A47F 3/04; A47F 3/0404; A47F 3/0408; F24F 1/10; F24F 1/16; F24F 2013/202
See application file for complete search history.

(56) References Cited

U.S. PATENT DOCUMENTS 3,866,867 A * 2/1975 LaRocca ..... F24F 1/10 62/448
2011/0114818 A1* 5/2011 Stupnik ..... F25D 23/006 248/618

* cited by examiner

*Primary Examiner* — Tavia Sullens
(74) *Attorney, Agent, or Firm* — Laurence A. Greenberg; Werner H. Stemer; Ralph E. Locher

(57) ABSTRACT

For the purpose of improving a usability a home appliance device, in particular a home chiller appliance device, is proposed: The home appliance device has a machine compartment having at least one wall section; a compressor which is arrangeable inside the machine compartment; and a fixation unit for fixating the compressor to the wall section via at least one movement at least of the compressor with respect to the wall section in a direction which is at least substantially parallel to a main extension plane of the wall section.

12 Claims, 9 Drawing Sheets

HOME APPLIANCE DEVICE

BACKGROUND OF THE INVENTION

Field of the Invention

The invention relates to a home appliance device, in particular a home chiller appliance device.

From the prior art a home appliance is known comprising a machine compartment and a compressor which is fixed to a base plate of the machine compartment by means of a screw connection.

SUMMARY OF THE INVENTION

An objective of the invention is, in particular, to provide a home appliance device with improved characteristics regarding usability. This objective is achieved, according to the claimed invention, while further implementations and further developments of the invention may be gathered from the dependent claims.

A home appliance device, in particular a home chiller appliance device, is proposed, comprising: a machine compartment having at least one wall section; a compressor which is arrangeable inside the machine compartment; and a fixation unit for fixating the compressor to the wall section via at least one movement at least of the compressor with respect to the wall section in a direction which is at least substantially parallel to a main extension plane of the wall section.

By means of the invention, in particular a usability of the home appliance device can be improved. In particular an assembly and/or disassembly of the compressor inside the machine compartment can be carried out more swiftly, due to which preferably maintenance and serviceability characteristics can also be improved.

A "home appliance device" is in particular to be understood as a portion, preferably a sub-assembly group, of a home appliance and/or a construction kit of a home appliance. The home appliance is, in this context, in particular provided for storing and preferably tempering victuals such as beverages, in particular alcoholic beverages such as wine, meat, fish, vegetables, fruits, milk and/or dairy products, in at least one operating state, advantageously for the purpose of enhancing a quality and/or a keepability of the stored victuals.

For example, the home appliance is embodied as a home chiller appliance, which is in at least one operating state configured for cooling victuals. The home chiller appliance could in particular be embodied as a climate cabinet, an ice-box, a wine-cooler, a freezer and/or a refrigerator-freezer combination. For example, the home chiller appliance is embodied as a refrigerator. The home appliance device comprises in particular a housing which preferably defines a storage compartment of the home appliance device. The storage compartment is in particular a compartment inside the home appliance device, which is provided for storing victuals. In this context, "configured" is in particular to mean specifically programmed, designed and/or equipped. By an object being configured for a certain function is in particular to be understood that the object implements and/or fulfills said certain function in at least one application state and/or operating state.

In this context, a "machine compartment" is in particular to be understood as a compartment which may be closed from at least three, preferably from at least four and possibly from at least five sides and which may in particular be configured for accommodating further units of the home appliance device, in particular at least partly accommodating a refrigerant cycle. The machine compartment may differ in particular from the storage compartment of the home appliance device, which is configured for storing victuals. In this context, a "refrigerant cycle" is in particular to be understood as a cycle which is configured for transferring heat out of a storage compartment. The refrigerant cycle may in particular be embodied as an adsorption-type and/or Peltier-type refrigerant cycle. Preferably the refrigerant cycle is embodied as a compression-type refrigerant cycle. The refrigerant cycle may in particular comprise main components such as a compressor, a condenser, a dryer, an expansion device, an evaporator and/or a heat exchanger.

The wall section is in particular implemented as a bottom wall section, for example as a base plate of the machine compartment. The machine compartment may comprise in particular a plurality of further wall sections, namely two lateral wall sections, a rear wall section, a bottom wall section and a front wall section, wherein the bottom wall section extends from the rear wall section to the front wall section. The two lateral wall sections, the rear wall section, the bottom wall section and the front wall section in particular delimit the machine compartment from five sides. The machine compartment may be delimited from a sixth side by a storage compartment of the home appliance device or a top wall of the machine compartment. The front wall section may comprise in particular an air inlet vent and/or an air outlet vent, which are in particular arranged side by side and are implemented lamellar. The wall section and the further wall sections may preferably be at least partly fixable to each other. Alternatively the wall section and/or the further wall sections may at least partly be implemented integrally. The wall section and/or the further wall sections of the machine compartment may in particular be made of metal and may be embodied as an, in particular bent, metal sheet. Alternatively or additionally the machine compartment may comprise an additional wall section, namely a top wall section, which delimits in particular the machine compartment from the sixth side. In this context, "at least substantially parallel" is in particular to be understood as an orientation of a direction with respect to a reference direction, in particular in a plane, wherein the direction and the reference direction include an angle of 0°, the orientation in particular having a deviation of less than 15°, advantageously of less than 10° and particularly advantageously of less than 2°. A "main extension plane" of an object is, in particular, to be understood as a plane which is oriented in parallel to a largest side of an imaginary rectangular cuboid which only just entirely encloses the object.

Furthermore, the fixation unit is in particular configured for fixating the compressor to a wall section of a machine compartment via at least one movement at least of the compressor with respect to the wall section in a direction which is at least substantially perpendicular to a main extension plane of the wall section. In particular, the fixation unit is configured for fixating the compressor to the wall section via an initial movement of the compressor in a direction which is at least substantially perpendicular to the main extension plane of the wall section and subsequently via a movement in a direction which is at least substantially parallel to the main extension plane of the wall section. In this context, "at least substantially perpendicular" is in particular to be understood as an orientation of a direction with respect to a reference direction, in particular in a plane, wherein the direction and the reference direction include an angle of 90°, the orientation having in particular a deviation of less than 15°, advantageously of less than 10° and particularly advantageously of less than 2°.

The fixation unit may comprise in particular at least one or at least two or exactly two support elements. In this context, a "support element" is to be understood as an element which is configured for bearing at least partly or at least mostly or entirely a weight force of at least one other object. The support element may bear in particular at least partly or at least mostly or entirely a weight force at least of the compressor. The term "at least mostly" with reference to an object is in particular to mean by more than 50%, preferably by more than 65%, further preferably by more than 80% and advantageously by more than 95% of an object, in particular of a surface area and/or of a volume and/or of a mass of the object. The support element may in particular be embodied as a rail. The support element is in particular implemented as a bent piece of sheet metal. Alternatively the support element may be implemented as an injection-molded part. In case the fixation unit comprises at least two support elements, these support elements may in particular be separate elements and may additionally be identical elements.

Further, it is proposed that the fixation unit may comprise at least one guiding element and at least one, in particular corresponding, guiding element which cooperates with the guiding element for guiding the movement of the compressor with respect to the wall section. In particular, the fixation unit may comprise at least two guiding elements and in particular at least two corresponding guiding elements for each respective support element. The guiding elements and/or the corresponding guiding elements may in particular be arranged offset with respect to each other, respectively, in a direction which is at least substantially parallel to a main extension plane of the wall section and/or in particular at least substantially perpendicular to a main extension of the support element. The guiding element may be implemented integrally with the support element. The corresponding guiding element may be implemented integrally with the wall section. In this context, "Implemented integrally" is in particular to mean, connected at least by substance-to-substance bond, e.g. by a welding process, an adhesive bonding, an injection-molding process and/or by another process that is deemed expedient by a person having ordinary skill in the art. For example, "implemented integrally" could in particular mean made of one piece. "Made of one piece" is in particular to mean, in this context, manufactured from one single piece, e.g. by production from one single cast and/or by manufacturing in a one-component or multi-component injection-molding process, and advantageously from a single blank. As a result of this, in particular an assembly of the compressor inside the machine compartment can be simplified as the guiding element and the corresponding guiding element limit play of the compressor, in particular during the assembly.

In a further embodiment of the invention it is proposed that the guiding element may be implemented as a guiding protrusion. In an installed state of the support element, a main extension of the support element is at least substantially parallel to the main extension plane of the wall section. A "main extension" of an object is, in particular, to be understood as a largest extension of an imaginary rectangular cuboid which only just entirely encloses the object and preferably extends through a geometric center of the object. Exemplarily it is proposed that the corresponding guiding element is implemented as a guiding recess. In particular the wall section comprises the guiding recess. For example the guiding recess is implemented as a slotted recess and advantageously as a slotted hole comprising in particular a main extension which is at least substantially parallel to the main extension plane of the wall section. As a result of this, in particular, the guiding element can be implemented in a simple manner. Costs for additional components can be dispensed with.

It is also proposed that the fixation unit may comprise at least one fixation element and at least one corresponding fixation element which cooperates with the fixation element for fixating the compressor to the wall section at least in a form-fit and/or force-fit manner. In particular, the fixation unit may comprise at least two fixation elements and at least two corresponding fixation elements for each respective support element. The fixation elements and/or the respective corresponding fixation elements may in particular be arranged offset with respect to each other in a direction which is at least substantially parallel to a main extension plane of the wall section and/or in particular at least substantially perpendicular to a main extension of the support element. The term "fixating in a force-fit and/or form-fit manner" is in particular to mean preferably releasably fixated, wherein a holding force between two structural components is preferably transferred via a geometric engagement of the structural components with each other and/or preferably via a friction force acting between the structural components. Alternatively or additionally a connection may be provided by substance-to-substance bond, e.g. an adhesive and/or cohesive connection. The fixation element may in particular be at least partly implemented integrally with the support element. The fixation element and the corresponding fixation element may implement a snap-fit connection, wherein in particular the first fixation element snaps into the corresponding fixation element. As a result of this, in particular an assembly and/or disassembly can be simplified.

It is also proposed that the fixation element may at least be partly implemented integrally with the guiding element. Further, the fixation element may be at least partly implemented integrally with the support element. For example, the fixation element may be implemented as a fixation hook. It is also proposed that the corresponding fixation element may at least partly be implemented integrally with the corresponding guiding element. Further, the corresponding fixation element may be at least partly implemented integrally with the wall section. The corresponding fixation element may be implemented as a fixation recess. The fixation recess may in particular be embodied by an end portion of the corresponding guiding element. As a result of this, in particular component costs can be reduced.

Furthermore, the fixation unit may comprise at least one further guiding element, and at least one further corresponding guiding element which cooperates with the guiding element for guiding the movement of the compressor with respect to the wall section. In particular, the fixation unit may comprise at least two further guiding elements and in particular at least two further corresponding guiding elements for each respective support element. The further guiding elements and/or the respective further corresponding guiding elements may in particular be arranged offset to each other, respectively, in a direction which is at least substantially parallel to a main extension plane of the wall section and in particular at least substantially perpendicular to a main extension of the support element. In particular, the further guiding element and/or the further corresponding guiding element may be arranged offset to the guiding element and/or the corresponding guiding element, in a direction which is at least substantially parallel to a main extension direction of the support element and/or which is at least substantially parallel to the main extension of the support element. It is proposed that the fixation unit may comprise at least one further fixation element, and at least one further corresponding fixation element which cooperates with the fixation element for fixating the compressor to the wall section at least in a form-fit and/or force-fit manner. In particular the fixation unit may comprise at least two further fixation elements and at least two further corresponding fixation elements for each respective support element. The further fixation elements and/or the respective further corresponding fixation elements may in particular be arranged offset with respect to each other, respectively, in a direction which is at least substantially parallel to a main extension plane of the wall section and in particular at least substantially perpendicular to a main extension of the support element. In particular, the further fixation element and/or the further corresponding fixation element may be arranged offset to the fixation element and/or the corresponding fixation element, respectively, in a direction which is at least substantially parallel to a main extension direction of the support element and/or which is at least substantially parallel to the main extension of the support element. The further fixation element and the further corresponding fixation element may in particular be implemented at least substantially identically to the fixation element and the corresponding fixation element, respectively. Alternatively or additionally the fixation unit may comprise at least one additional fixation element and at least one additional corresponding fixation element, which may be implemented differing from the fixation element and the corresponding fixation element respectively. In particular, the additional fixation element and/or the additional corresponding fixation element may be arranged offset to the fixation element and/or the corresponding fixation element, in a direction which is at least substantially parallel to a main extension direction of the support element and/or which is at least substantially parallel to the main extension of the support element. The additional fixation element may be implemented as a screw hole and the additional corresponding fixation element may be implemented as a corresponding screw bore. The fixation unit may comprise in particular at least one interacting element which interacts with the additional fixation element and the additional corresponding further fixation element for fixating the compressor to the inner wall section. The interacting element may be implemented as a screw. The additional fixation element and the additional corresponding fixation element may implement at least partly a screw connection. As a result of this, in particular stability can be increased.

It is further proposed that the home appliance device may further comprise an evaporation tray, which is arranged at least partly between the compressor and the fixation unit, in particular between the support element of the fixation unit and the compressor. The evaporation tray may in particular be configured for collecting condensed water preferably from a storage compartment of the home appliance device and for evaporating the condensed water. For example there may be a pipe or drainage having an open end which is directed into or towards the evaporation tray, such that condensed water leaving the open end will be collected in the evaporation tray. The evaporation tray may in particular be arranged in direct contact with the support element and/or the compressor. The compressor may rest on the evaporation tray directly or indirectly, e.g. via damping elements. The evaporation tray may bear at least partly or at least mostly or entirely a weight force of the compressor, possibly additionally also of further components such as for example a control unit, e.g. an electrical control unit of the compressor. The evaporation tray may be thermally coupled to the compressor. The support element may bear in particular at least partly or at least mostly or entirely a weight force at least of the evaporation tray. As a result of this, in particular a compactness of the construction of the home appliance device can be improved. The evaporation tray may be made of metal, e.g. sheet metal, or plastic, e.g. injection molded. The evaporation tray may include reinforcing ribs. These ribs increase the structural stability of the evaporation tray which may be beneficial when removing the evaporation tray from the machine room while the compressor and/or other components are located on the evaporation tray. The evaporation tray may extend only over a subregion of the wall section. In particular, in case the wall section is a bottom wall of the machine compartment, the evaporation tray may only extend over half or over a third of the area of the bottom wall with respect to a main extension of the bottom wall. The evaporation tray may extend in a width direction of the machine room over 30% to 60%, for example essentially over 50%, of the width of the machine room. The evaporation tray may extend in depth direction of the machine room over 75% to 100%, for example essentially 90%, of the depth of the machine room. The evaporation tray may essentially extend from a front end of the machine room up to a rear end of the machine room and/or from one side wall of the machine room up to a middle region of the machine room allowing several components such as the compressor and/or control units, e.g. for the compressor, to be located on the evaporation tray, in particular to form a pre-assembly unit.

In a further embodiment of the invention it is proposed that the compressor and the evaporation tray may be connected to the fixation unit by means of at least one, connection element of the fixation unit. The fixation unit may comprise at least two connection elements for each respective support element. The connection element may in particular be implemented as a bent piece of sheet metal.

For example, the connection element may at least partly be implemented integrally with the support element. As a result of this, in particular additional component cost can be dispensed with as the evaporation tray and the compressor can be connected via the same connection element. A stability of the home appliance device can be further improved in this way.

It is also proposed that the fixation unit may comprise at least one damping element for damping at least a vibration of the compressor with respect to the fixation unit. The fixation unit may comprise at least one damping element for each respective connection element. The damping element may at least essentially or completely be rotationally symmetric. The damping element may comprise a hole or opening, e.g. a through hole, in particular centrally located, which allows the damping element to be placed onto the fixation element such that the damping element at least partly surrounds the fixation element.

Preferably the evaporation tray may comprise at least one accommodation recess for the damping element, inside which the damping element is arranged. The accommodation recess and the evaporation tray may be formed integrally. The accommodation recess may comprise a hollow cylinder with at least one open end. An axis of the cylinder may be located vertically in an installed state of the evaporation tray and the open end may be located on the top end of the cylinder. Opposite the open end may be a bearing surface on which the damping element may rest. The bearing surface may be formed as a top surface of a socket extending perpendicular out of a main extension plane of the evaporation tray, in particular extending vertically upwards in an installed state of the evaporation tray. The bearing surface, and if present also the socket, may have a hole or opening, in particular centrally located within the bearing surface, for passing through of the fixation element. The accommodation recess may be raised with respect to a lower bottom wall portion of the evaporation tray; in this way condensed water accumulating in the evaporation tray will not flow into the accommodation recess. The damping element may be insertable into the accommodation recess via the open end. The damping element may comprise a cylindrical outer surface. There may be a gap between the cylindrical outer surface of the damping element and a cylindrical inner surface of the hollow cylinder. The gap may be dimensioned in radial direction such that the damping element may be easily insertable by hand into the hollow cylinder while the functionality of the damping element (e.g. being fixable to the fixation element and/or being fixable to the compressor) might be ensured independent of the position taken by the damping element due to possible movements of it due to the gap. In particular in an installed state of the compressor the damping element may be arranged at least partly between the compressor and the fixation unit, e.g. the support element of the fixation unit.

The damping element may in particular be deformable and in particular elastically deformable. The damping element may in particular be made at least partly of a deformable material, such as rubber. As a result of this, in particular wear of the fixation unit and in particular of the connection element, due to vibration of the compressor can be advantageously reduced.

The compressor may be fixed to the at least one damping element via a force-fit and/or form-fit connection. In particular, the compressor may only be fixed to the at least one damping element and/or rests only on the at least one damping element. The compressor may have at least one, for example two, compressor foots and the at least one compressor foot may be fixed to the at least one damping element. The at least one compressor foot may have at least one, e.g. two, holes into which the damping element may be pressed.

It is also proposed, that the at least one support element and the compressor form a pre-assembly unit. A "pre-assembly unit" in particular is a unit which after all elements of the pre-assembly unit are fixed or attached to each other can be mounted into and removed from the home appliance device as a single unit. In particular a worker can handle this unit without the risk or possibility of one of the elements being lost or unintentionally displaced with respect to each other during handling. In particular, the elements of the pre-assembly unit can be fixed or attached to each other yielding in a "mounted state" of these elements with respect to each other, and this mounted state will not change once the pre-assembly unit is mounted into the home appliance device. The pre-assembly unit may be mounted, in particular fixed, to the home appliance device, e.g. the machine room, by connections between the wall section and the support element, in particular only by these connections. Said pre-assembly unit can in particular also comprise the at least one damping element and/or the evaporation tray and/or further components, in particular electrically or fluidly connected to the compressor, such for example a control device for the compressor. According to one embodiment the pre-assembly unit may comprise two support elements each having two connection elements onto which the evaporation tray is mounted and/or positioned from top through four openings or holes of the evaporation tray, wherein four damping elements are mounted and/or positioned from top onto the four connection elements such that the damping elements surround the connection elements and rest on the evaporation element and the compressor is mounted and/or positioned from top onto the four connection elements such that the compressor rests on the damping elements. The compressor may be fixed to the damping elements. The fixation of the compressor, e.g. to the damping element, may be directly or indirectly, e.g. using a fixation plate. Said fixation plate may be positioned on top of the damping elements and may be fixed to the damping elements via the connection elements, e.g. by a force-fit and/or form-fit connection. The fixation plate may have at least one, e.g. two, holes and/or slots through which the connection elements may extend.

The wall section may in particular be a bottom wall of the machine compartment and extend essentially horizontally. In particular said bottom wall may extend essentially completely between both lateral side walls of the machine compartment and/or may extend essentially completely along the complete depth direction of the machine wall. The wall section may in this way contribute to the structural stability of the home appliance device.

In case the home appliance device comprises an evaporation tray, the evaporation tray may be located above the wall section, in particular above a bottom wall as wall section. In particular the wall section may essentially extend completely below the evaporation tray.

Further a method for assembly of a home appliance device is proposed, wherein a compressor is fixated to a wall section of a machine compartment via at least one movement at least of the compressor with respect to the wall section in a direction which is at least substantially parallel to a main extension plane of the wall section. In particular, the compressor is fixated to the wall section of the machine compartment via at least one movement at least of the compressor with respect to the wall section in a direction which is at least substantially perpendicular to the main extension plane of the wall section. In particular, in assembly the compressor is moved initially in a direction which is at least substantially perpendicular to the main extension plane of the wall section and subsequently in a direction which is at least substantially parallel to the main extension plane of the wall section. In this way, in particular a usability of the home appliance device can be improved.

The method may include the step of forming a pre-assembly unit before the step of fixing the compressor to the wall section, the pre-assembly unit comprising the at least one support element and the compressor. The step of forming the preassembly unit may comprise the sub-steps of:

- Placing the compressor, in particular from top, on the at least one support element
- Fixing the compressor to the at least one support element The pre-assembly unit may also include the at least one damping element and/or the evaporation tray, such that the step of forming the pre-assembly unit may include the sub-steps

- Placing the evaporation tray, in particular from top, on the at least one support element
- Placing the at least one damping element, in particular from top, on the evaporation tray
- Placing the compressor, in particular from top, on the at least one damping element
- Fixing the compressor to the at least one support element and/or the at least one damping element The sub-step of fixing the compressor may be performed by placing a fixation plate having two holes and/or slots on top of two connection elements followed by establishing a force-fit and/or form-fit between the fixation plate and the two connection elements.

Herein the home appliance device and the method for assembly of a home appliance device are not to be limited to the application and implementation described above. In particular, for the purpose of fulfilling a functionality herein described, the home appliance device may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing an exemplary embodiment of the invention is shown. The drawing, the description and the claims contain a plurality of features in combination. The person having ordinary skill in the art will purposefully also consider the features separately and will find further expedient combinations.

If there is more than one specimen of a certain object, only one of these is given a reference numeral in the figures and in the description. The description of this specimen may be correspondingly transferred to the other specimens of the object.

DETAILED DESCRIPTION OF THE INVENTION

Figure 1:
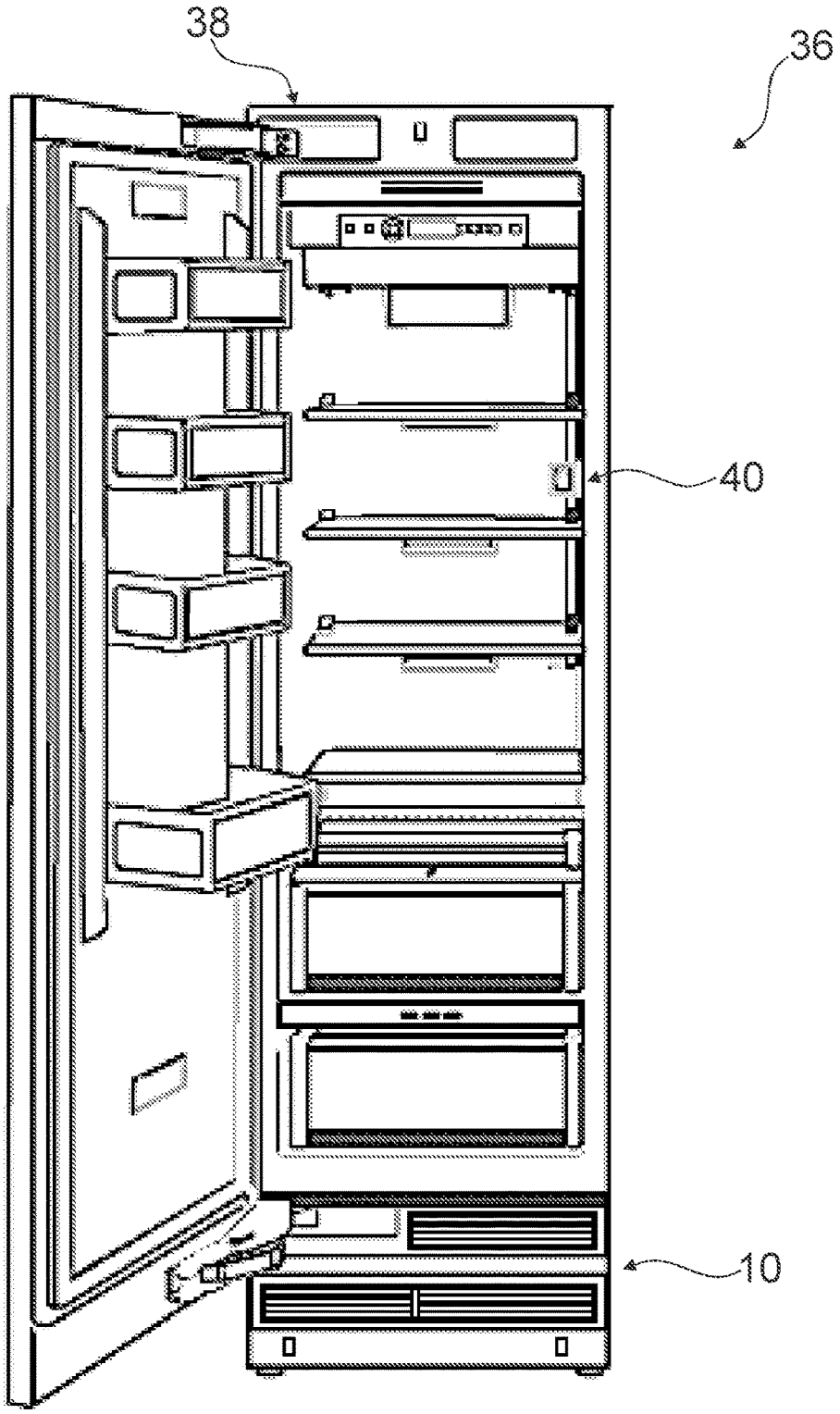
FIG. 1 a home appliance comprising a home appliance device in a schematic front view, FIGS. 2, 3 a portion of the home appliance device, comprising a machine compartment, in various perspective views, FIG. 4 a portion of the home appliance device, comprising a fixation unit, in an exploded view.

FIG. 1 shows a home appliance 36 comprising a home appliance device in a schematic front view. The home appliance 36 is embodied as a refrigerator. The home appliance 36 could further be embodied as a climate cabinet, an ice-box, a freezer, a refrigerator-freezer combination and/or a wine cooler.

The home appliance device comprises a housing 38. The home appliance device comprises a storage compartment 40. The storage compartment 40 is configured for storing victuals. The storage compartment 40 is arranged inside the housing 38.

The home appliance device comprises a machine compartment 10, which is arranged inside the housing 38. The machine compartment 10 is configured for accommodating further units of the home appliance device. In particular, the machine compartment 10 accommodates at least partly a refrigerant cycle of the home appliance device. In an installation position of the home appliance device, the machine compartment 10 is positioned below the storage compartment 40. Alternatively or additionally the machine compartment 10 could be positioned on top of the storage compartment 40.

Figure 2:
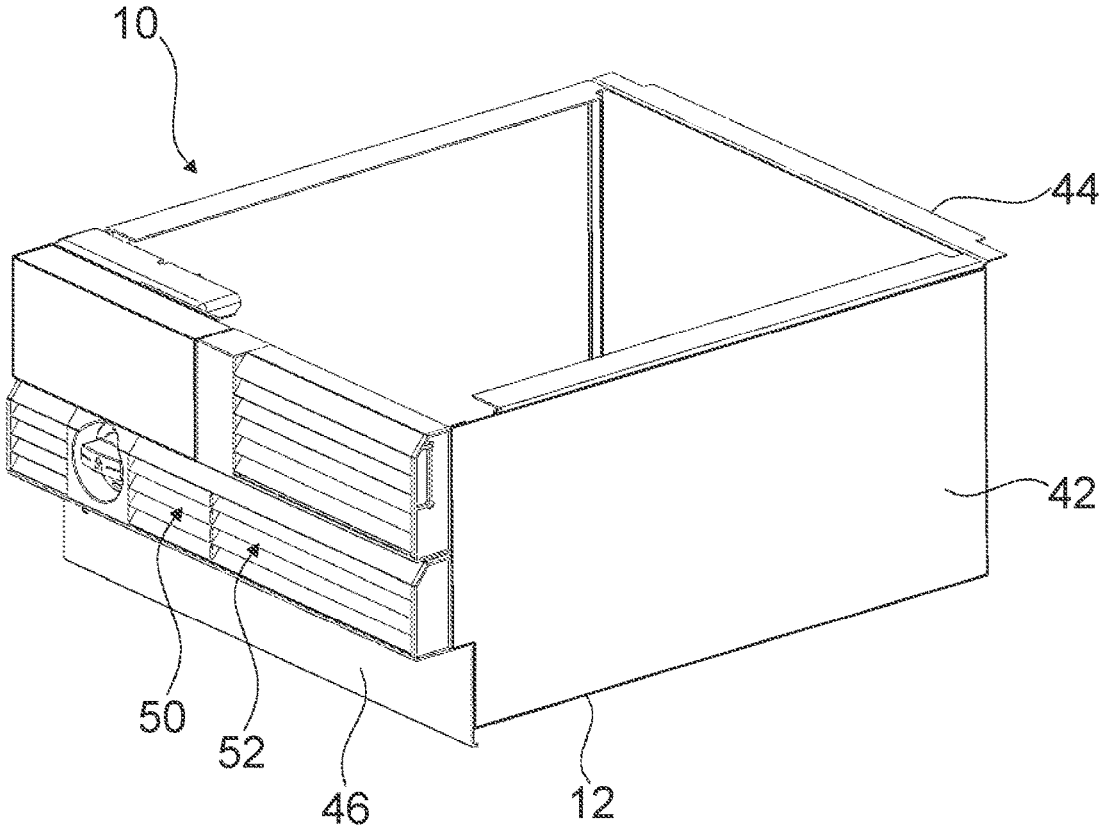
Figure 3:
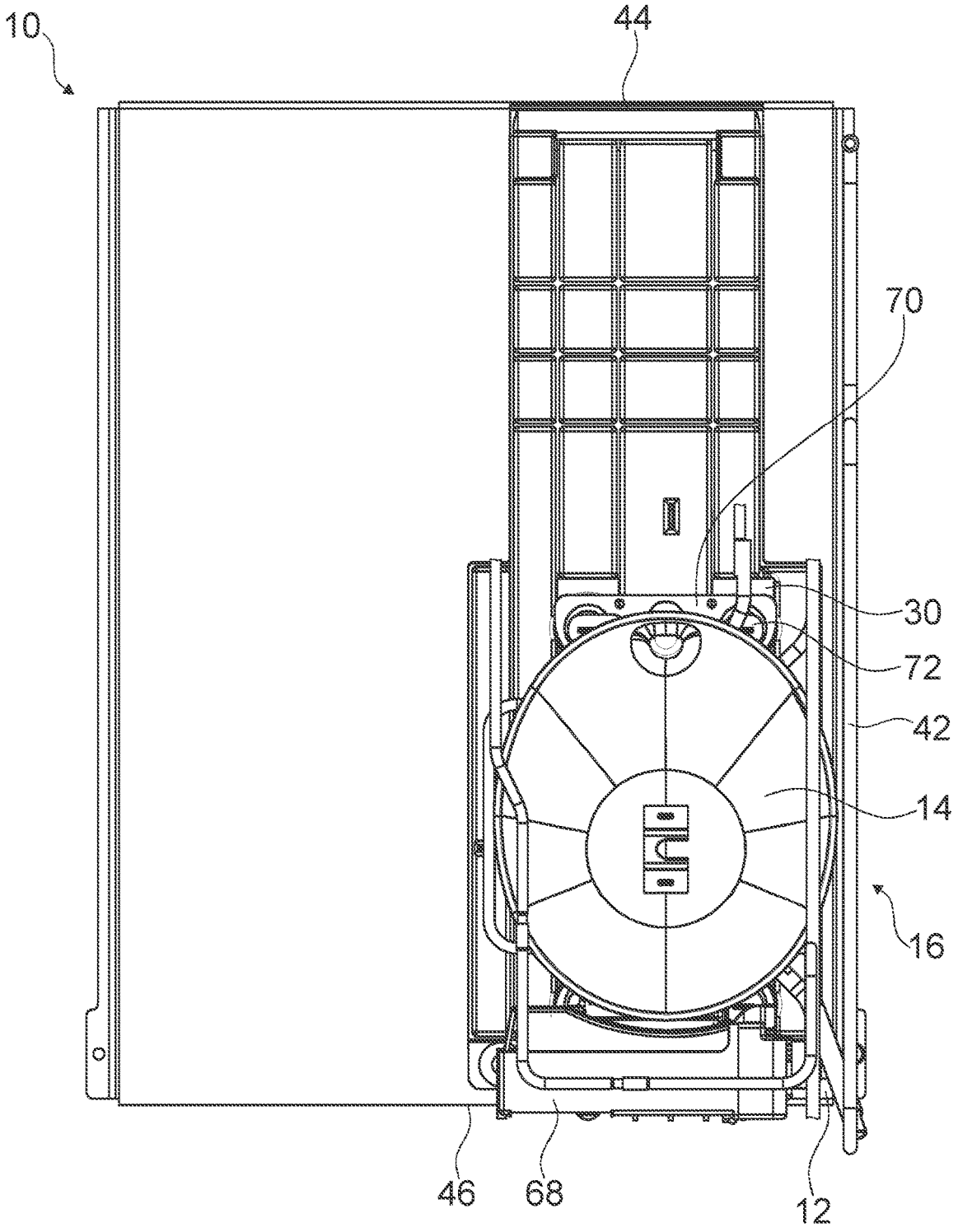

FIGS. 2 and 3 each show a portion of the home appliance device with the machine compartment 10 in different views. The machine compartment 10 comprises a wall section 12. The wall section 12 is embodied as a base plate of the machine compartment 10. The wall section 12 delimits the machine compartment 10 from a bottom side. The machine compartment 10 is further delimited by further wall sections 42, 44, 46. The further wall sections 42 delimit the machine compartment 10 from opposite lateral sides. The further wall section 44 delimits the machine compartment 10 from a rear side. The further wall section 46 delimits the machine compartment 14 from a front side. The further wall section 46 comprises an air inlet vent 50. Further the front wall section 46 comprises an air outlet vent 52. The air inlet vent 50 and the air outlet vent 52 are arranged side by side. The air inlet vent 50 and the air outlet vent 52 are implemented at least substantially lamellar. Alternatively or additionally other wall sections of the machine compartment 10 may comprise an air inlet vent and/or an air outlet vent.

The home appliance device comprises a compressor 14. The compressor 14 is part of a refrigerant cycle of the home appliance device. The compressor 14 is arrangeable inside the machine compartment 10. The home appliance device comprises a fixation unit 16 for fixating the compressor 14 to the wall section 12 via at least one movement at least of the compressor 14 with respect to the wall section 12 in a direction which is at least substantially parallel to a main extension plane of the wall section 12.

Figure 4:
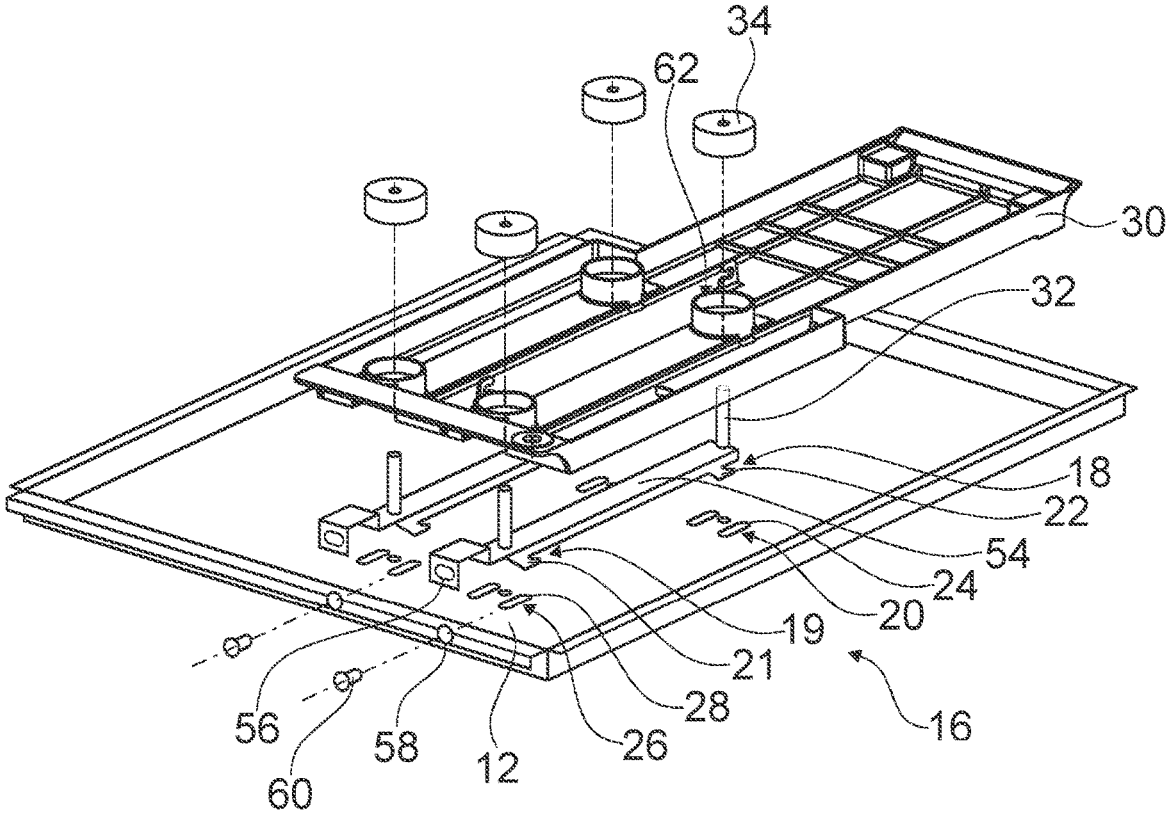

FIG. 4 shows a portion of the home appliance device with the fixation unit 16 in an exploded view. The fixation unit 16 comprises at least one support element 54. In the present case the fixation unit 16 comprises two support elements 54. The support elements 54 are arranged side by side, in particular offset from each other, in a direction which is at least substantially parallel to a main extension plane of the wall section 12 and/or at least substantially perpendicular to a main extension of the respective support element 54. In an installed state of the support element 54, a main extension of the support element 54 is at least substantially parallel to the main extension plane of the wall section 12. For the sake of clarity, in the following description and in the drawing only one support element 54 is given a reference numeral and is described in detail. The support element 54 is configured for bearing at least partly a weight force of the compressor 14. In the present case, the two support elements 54 bear the entire weight force of the compressor 14. The support element 54 is embodied as a rail. The support element 54 is in particular implemented as a bent piece of sheet metal. Alternatively the support element may be implemented as an injection-molded part.

The fixation unit 16 comprises at least one guiding element 18. In the present case the fixation unit 16 comprises four guiding elements 18, in particular two for each support element 54. The guiding elements 18 are arranged offset from each other in a direction which is at least substantially parallel to the main extension plane of the wall section 12 and/or at least substantially perpendicular to a main extension of the support element 54. For the sake of clarity, in the following description and in the drawing only one guiding element 18 is given a reference numeral and is described in detail. The guiding element 18 is implemented as a guiding protrusion. The guiding element 18 is implemented integrally with the support element 54.

The fixation unit 16 comprises at least one corresponding guiding element 20. In the present case the fixation unit 16 comprises four corresponding guiding elements 20, in particular two for each support element 54. The corresponding guiding elements 20 are arranged offset in a direction which is at least substantially parallel to the main extension plane of the wall section 12 and/or at least substantially perpendicular to a main extension of the support element 54. For the sake of clarity, in the following description and in the drawing only one corresponding guiding element 20 is given a reference numeral and is described in detail. The corresponding guiding element 20 is implemented integrally with the wall section 12. The corresponding guiding element 20 is implemented as a guiding recess. The corresponding guiding element 20 cooperates with the guiding element 18 for guiding the movement of the compressor 14 with respect to the wall section 12.

The fixation unit 16 comprises at least one fixation element 22. In the present case the fixation unit 16 comprises four fixation elements 22, in particular two for each support element 54. The fixation elements 22 are arranged offset from each other in a direction which is at least substantially parallel to the main extension plane of the wall section 12 and/or at least substantially perpendicular to the main extension of the support element 54. For the sake of clarity, in the following description and in the drawing only one fixation element 22 is given a reference numeral and is described in detail. The fixation element 22 is at least partly implemented integrally with the guiding element 18. The fixation element 22 is at least partly implemented integrally with the support element 54. The fixation element 22 is implemented as a fixation hook.

The fixation unit 16 comprises at least one corresponding fixation element 24. In the present case the fixation unit 16 comprises four corresponding fixation elements 24, in particular two for each support element 54. The corresponding fixation elements 24 are arranged offset in a direction which is at least substantially parallel to the main extension plane of the wall section 12 and/or at least substantially perpendicular to the main extension of the support element 54. For the sake of clarity, in the following description and in the drawing only one corresponding fixation element 24 is given a reference numeral and is described in detail. The corresponding fixation element 24 is at least partly implemented integrally with the wall section 12. The corresponding fixation element 24 is at least partly implemented integrally with the corresponding guiding element 20. The corresponding fixation element 24 is embodied as an end portion of the corresponding guiding element 20. The corresponding fixation element 24 is implemented as a fixation recess. The corresponding fixation element 24 cooperates with the fixation element 22 for fixating the compressor 14 to the wall section 12 at least in a form-fit and/or force-fit manner.

The fixation unit 16 comprises at least one further guiding element 19. In the present case the fixation unit 16 comprises four further guiding elements 19, in particular two for each support element 54. The further guiding elements 19 are arranged offset in a direction which is at least substantially parallel to the main extension plane of the wall section 12 and/or at least substantially perpendicular to the main extension of the support element 54. For the sake of clarity, in the following description and in the drawing only one further guiding element 19 is given a reference numeral and is described in detail. The further guiding element 19 is implemented at least substantially identically to the guiding element 18. The further guiding element 19 is arranged offset with respect to the guiding element 18 in a direction which is at least substantially parallel to the main extension plane of the wall section 12 and/or at least substantially parallel to the main extension of the support element 54.

The fixation unit 16 comprises at least one further corresponding guiding element 26. In the present case the fixation unit comprises four further corresponding guiding elements 26, in particular two for each support element 54. The further guiding elements 26 are arranged offset in a direction which is at least substantially parallel to the main extension plane of the wall section 12 and/or at least substantially perpendicular to the main extension of the support element 54. For the sake of clarity, in the following description and in the drawing only one further corresponding guiding element 26 is given a reference numeral and is described in detail. The further corresponding guiding element 26 is implemented at least substantially identically to the corresponding guiding element 20. The further corresponding guiding element 26 is arranged offset with respect to the corresponding guiding element 20 in a direction which is at least substantially parallel to the main extension plane of the wall section 12 and/or at least substantially parallel to the main extension of the support element 54. The further corresponding guiding element 26 cooperates with the further guiding element 19 for guiding the movement of the compressor 14 with respect to the wall section 12.

The fixation unit 16 comprises at least one further fixation element 21. In the present case the fixation unit 16 comprises four further fixation elements 21, in particular two for each fixation element 22. The further fixation elements 21 are arranged offset in a direction which is at least substantially parallel to the main extension plane of the wall section 12 and/or at least substantially perpendicular to the main extension of the support element 54. For the sake of clarity, in the following description and in the drawing only one further fixation element 21 is given a reference numeral and is described in detail. The further fixation element 21 is implemented at least substantially identically to the fixation element 22. The further fixation element 21 is arranged offset with respect to the fixation element 22 in a direction which is at least substantially parallel to the main extension plane of the wall section 12 and/or at least substantially parallel to the main extension of the support element 54. The further fixation element 21 is implemented at least partly integrally with the further guiding element 19.

The fixation unit 16 comprises at least one further corresponding fixation element 28. In the present case the fixation unit 16 comprises four further corresponding fixation elements 28, in particular two for each support element 54. The further corresponding fixation elements 28 are arranged offset in a direction which is at least substantially parallel to the main extension plane of the wall section 12 and/or at least substantially perpendicular to the main extension of the support element 54. For the sake of clarity, in the following description and in the drawing only one further corresponding fixation element 28 is given a reference numeral and is described in detail. The further corresponding fixation element 28 is implemented at least substantially identically to the corresponding fixation element 21. The further corresponding fixation element 28 is arranged offset with respect to the corresponding fixation element 21 in a direction which is at least substantially parallel to the main extension plane of the wall section 12 and/or at least substantially parallel to the main extension of the support element 54. The further fixation element 28 is at least partly implemented integrally with the further corresponding guiding element 26. The further corresponding fixation element 28 cooperates with the further fixation element 21 for fixating the compressor 14 to the wall section 12 at least in a form-fit and/or force-fit manner.

The fixation unit 16 comprises at least one additional fixation element 56. In the present case the fixation unit 16 comprises two additional fixation elements 56, in particular one for each support element 54. For the sake of clarity, in the following description and in the drawing only one additional fixation 56 element is given a reference numeral and is described in detail. The additional fixation element 56 is at least partly implemented integrally with the support element 54. The additional fixation element 56 is arranged offset with respect to the fixation element 22 and/or the further fixation element 21 in a direction which is at least substantially parallel to the main extension plane of the wall section 12 and/or at least substantially parallel to the main extension of the support element 54. The additional fixation element 56 is implemented as a screw hole. The additional fixation element 56 has an opening direction which is oriented at least substantially parallel to the main extension of the support element 54. The additional fixation element 56 is arranged at a bent-over portion of the support element 54.

The fixation unit 16 comprises at least one additional corresponding fixation element 58. In the present case the fixation unit 16 comprises two additional corresponding fixation elements 58, in particular one for each support element 54. For the sake of clarity, in the following description and in the drawing only additional corresponding fixation element 58 is given a reference numeral and is described in detail. The additional corresponding fixation element 58 is at least partly implemented integrally with the wall section 12. The corresponding fixation element 58 is arranged offset with respect to the corresponding fixation element 24 and/or the further corresponding fixation element 28 in a direction which is at least substantially parallel to the main extension plane of the wall section 12 and/or at least substantially parallel to the main extension of the support element 54. The additional corresponding fixation element 58 is implemented as a corresponding screw bore. The additional corresponding fixation element 58 has an opening direction which is at least substantially parallel to the main extension of the wall section 12. The additional corresponding fixation 58 element is arranged at a bent-over portion of the wall section 12.

The fixation unit 16 comprises at least one interacting element 60. In the present case the fixation unit 16 comprises two interacting elements 60, in particular one for each support element 54. For the sake of clarity, in the following description and in the drawing only one interacting element 60 is given a reference numeral and is described in detail. The interacting element 60 interacts with the additional fixation element 56 and the additional corresponding fixation element 58 for fixating the compressor 14 to the inner wall section 12. The interacting element 60 is implemented as a screw. The additional fixation element 56, the additional corresponding fixation element 58 and the interaction element 60 implement a screw connection.

The home appliance device further comprises an evaporation tray 30. The evaporation tray 30 is in particular configured for collecting condensed water preferably from a storage compartment 40 of the home appliance device and for evaporating the condensed water. The evaporation tray 30 is arranged at least partly between the compressor 14 and the fixation unit 16. The evaporation tray 30 is at least in indirect, preferably in direct contact with the fixation unit 16, in particular with the support element 54. The evaporation tray 30 is at least in indirect, preferably in direct contact with the compressor 14. Preferably the evaporation tray 30 may be thermally coupled to the compressor 14.

Figure 5A:
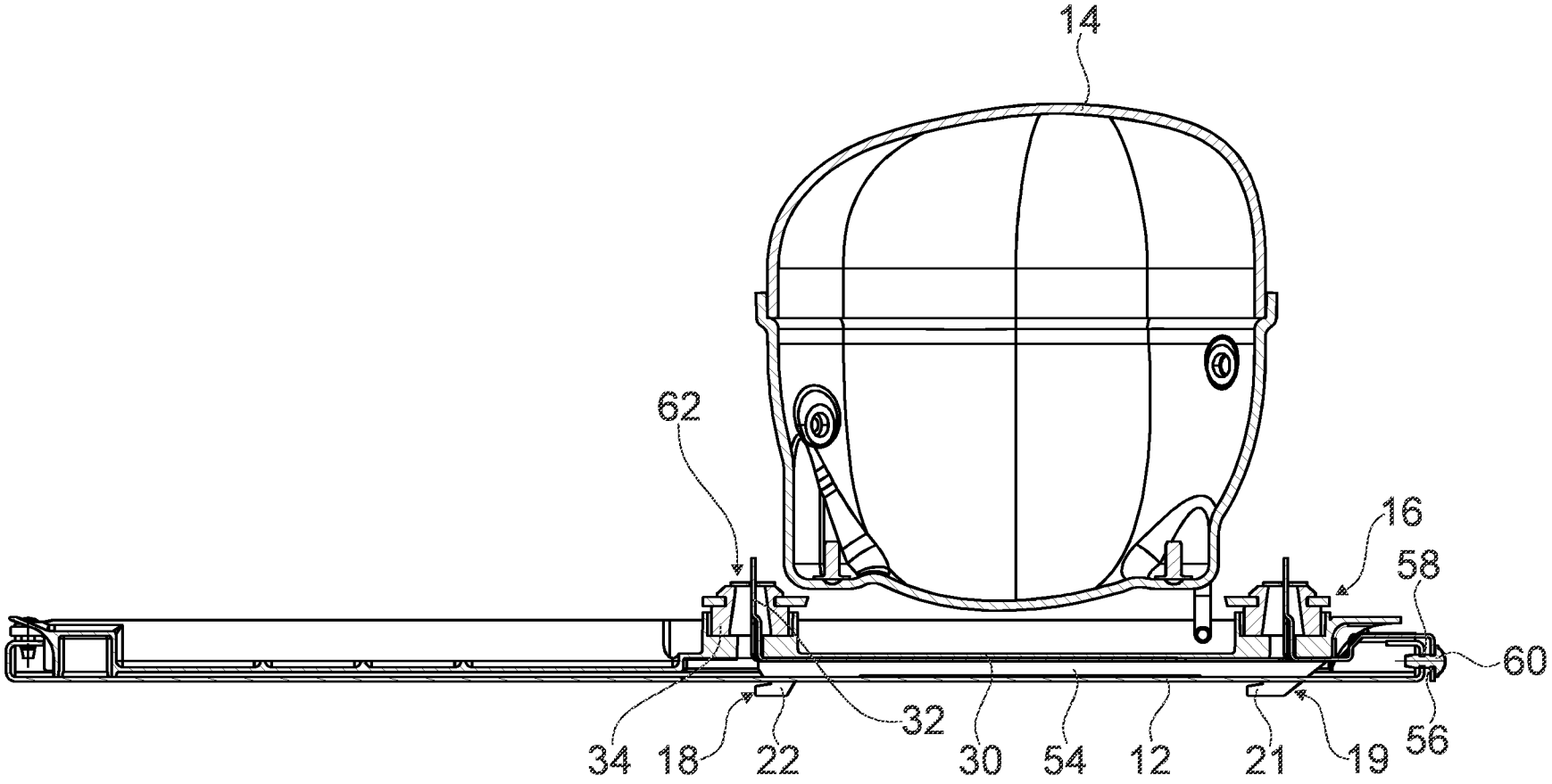
FIGS. 5*a-b* a portion of the home appliance device, comprising the fixation unit, in a cross-sectional view, FIG. 6*a-b* a portion of the home appliance device in different assembly steps, and FIG. 7 a schematic diagram of a method for assembling a portion of the home appliance device.
Figure 5B:
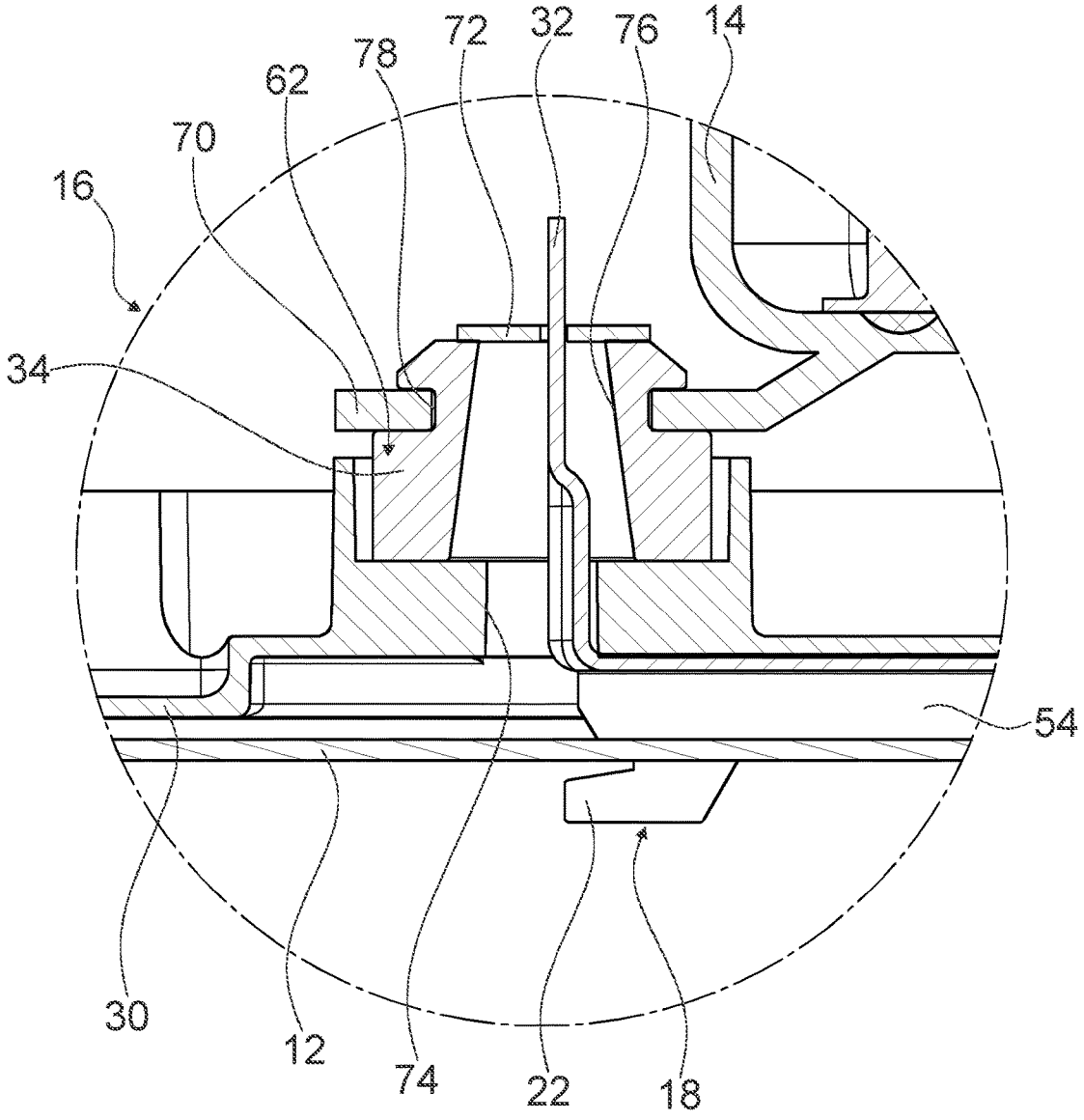

The fixation unit 16 comprises at least one connection element 32. In the present case the fixation unit 16 comprises four connection elements 32, in particular two for each respective support element 54 (see FIGS. 5*a*, 5*b*). The connection elements 32 are arranged offset in a direction which is at least substantially parallel to the main extension plane of the wall section 12 and/or at least substantially perpendicular to the main extension of the support element 54. For the sake of clarity, in the following description and in the drawing only one connection element 32 is given a reference numeral and is described in detail. By means of the connection element 32, the compressor 14 is connected to the fixation unit 16, in particular to the support element 54 and/or to the evaporation tray 30. By means of the connection element 32 the evaporation tray 30 is connected to the fixation unit 16, in particular to the support element 54. The connection element 32 is at least partly implemented integrally with the support element 54. The connection element 32 is implemented as a bent piece of sheet metal.

The home appliance device further comprises at least one damping element 34. In the present case the home appliance device comprises four damping elements 34, in particular one for each connection element 32. For the sake of clarity, in the following description and in the drawing only one damping element 34 is given a reference numeral and is described in detail. The damping element 34 is configured for damping at least a vibration of the compressor 14 with respect to the fixation unit 16. The evaporation tray 30 comprises an accommodation recess 62. The damping element is at least partly, preferably mostly accommodated in the accommodation recess 62.

As depicted in 5*b* the accommodation recess 62 is vertically raised with respect to a bottom wall of the evaporation tray 30 by having a socket onto which a hollow cylinder is formed. In this way, condensed water accumulating within the evaporation tray cannot enter the accommodation recess 62 via a top end of the cylinder being an open end of the cylinder. The socket forms a bearing surface for the damping element 34. The bearing surface has an hole 74 in form of a through hole. The connection element 32 passes through this hole 74.

The damping element 34 has a hole 76 in form of a through hole. The connection element 32 passes through this hole 76. The damping element 34 has a cylindrical outer surface. Between this cylindrical outer surface and a cylindrical inner surface of the cylinder is a clearance.

The compressor 14 has two compressor feet 70 which are attached to the damping element 34. In particular, each compressor foot 70 has two holes 78 into which the damping elements 34 are pressed. Each damping element 34 has a circular contraction which encompasses an edge of the hole 78. The compressor rests on the damping elements 34. In particular, the compressor rests only on the damping elements 34 and is fixed only to the damping elements 34.

The fixation unit 16 comprises two fixation plates 72. Each fixation plate 72 has two slots or holes. Through each slot or hole passes one connection element 32. A fixation between the fixation plate 72 and the connection element 32 can be achieved by adding an additional fixing element (not shown in FIG. 5*b*) on top of the free end of the connection element 32 and/or by plastically deforming the free end of the connection element 32 (not shown in FIG. 5*b*).

Figure 6A:
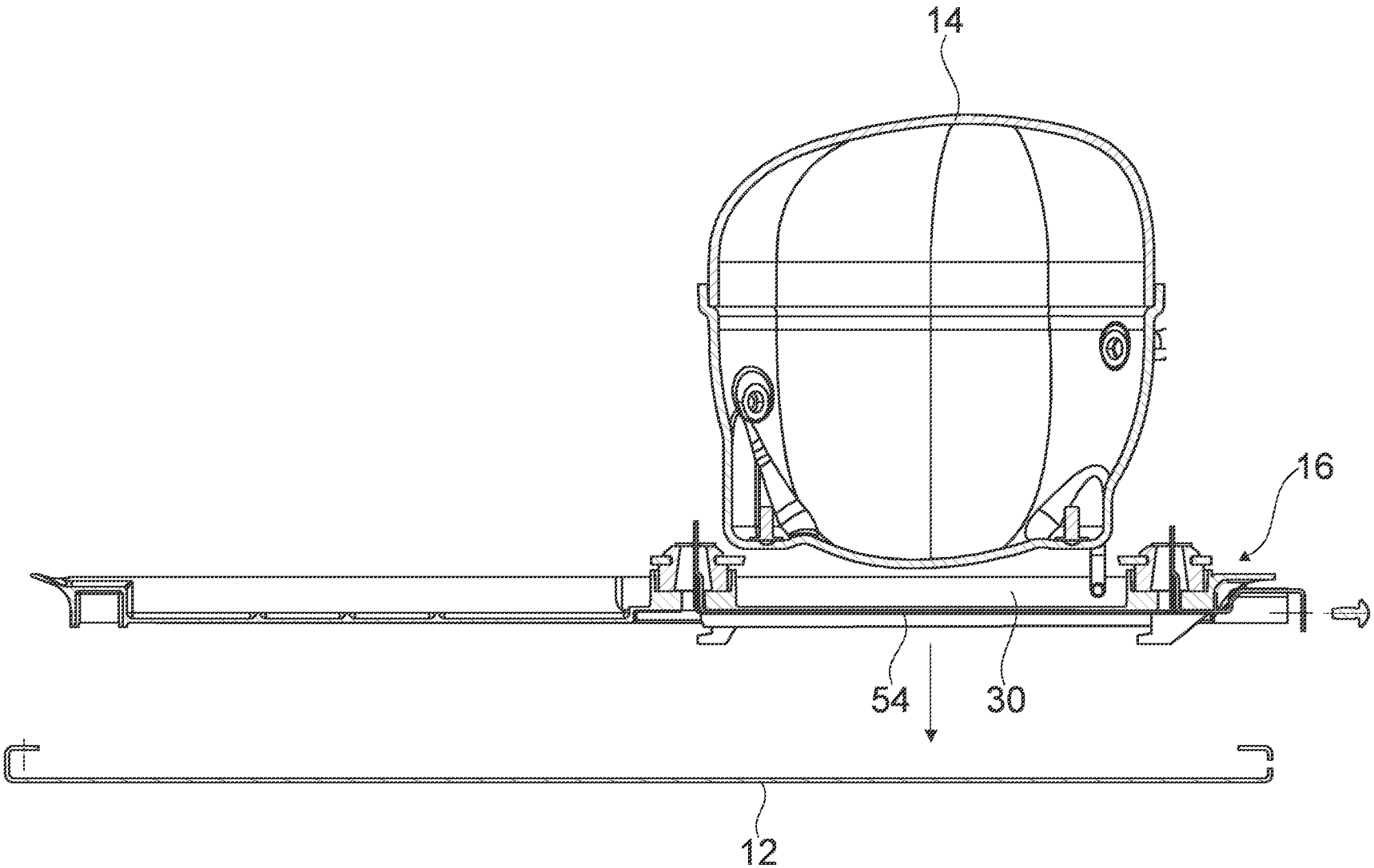
Figure 6B:
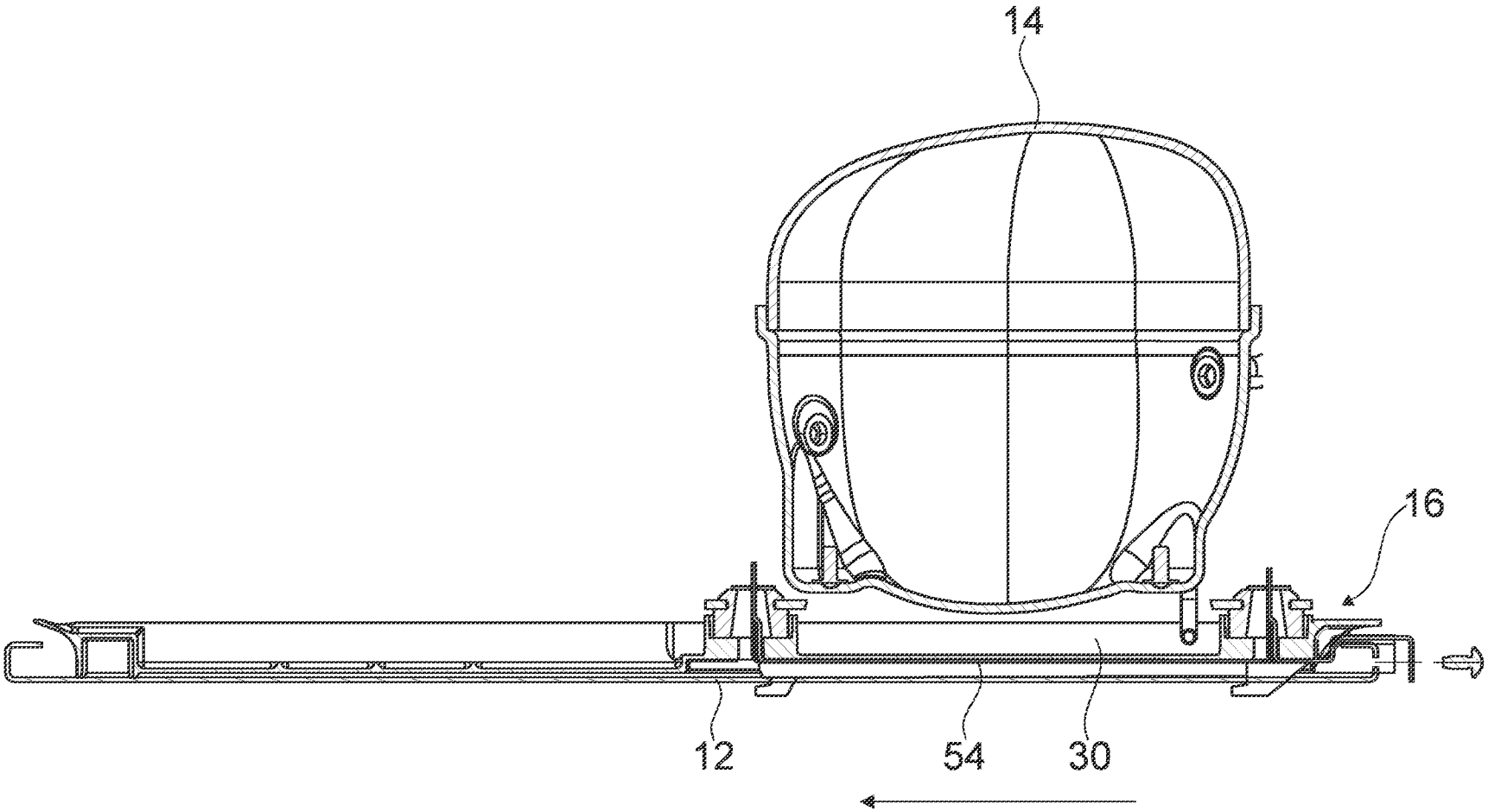
Figure 7:
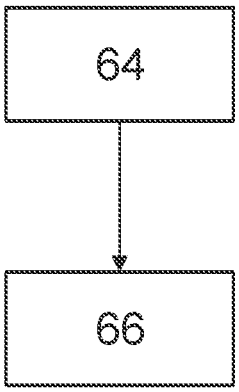

FIGS. 6*a*, 6*b* show a schematic diagram of a method for fixating the compressor 14 to the wall section 12. In a method step 64 the compressor 14 is fixated to a wall section of a machine compartment via at least one movement at least of the compressor with respect to the wall section in a direction which is at least substantially perpendicular to a main extension plane of the wall section. In a further method step 66 the compressor 14 is fixated to a wall section of a machine compartment via at least one movement at least of the compressor with respect to the wall section in a direction which is at least substantially perpendicular to a main extension plane of the wall section.

The following is a summary list of reference numerals and the corresponding structure used in the above description of the invention:

10 Machine compartment
12 Wall section
14 Compressor
16 Fixation unit
18 Guiding element
19 Further guiding element
20 Corresponding guiding element
21 Further fixation element
22 Fixation element
24 Corresponding fixation element
26 Further corresponding guiding element
28 Further corresponding fixation element
30 Evaporation tray
32 Connection element
34 Damping element
36 Home appliance
38 Housing
40 Storage compartment
42 Wall section
44 Wall section
46 Wall section
50 Inlet vent
52 Outlet vent
54 Support element
56 Additional fixation element
58 Additional corresponding fixation element
60 Interacting element
62 Accommodation recess
64 Method step
66 Further method step
68 Control device
70 Compressor foot
72 Fixation plate
74 Hole
76 Hole
78 Hole

The invention claimed is:

1. A home appliance device, comprising:
a machine compartment having at least one wall section, the wall section having a slot formed therein;
a compressor which is arrangeable inside the machine compartment; and
a fixation unit for removably mounting the compressor to the wall section the fixation unit having a rail attached to the compressor, the rail having a hook, the hook configured for being received in the slot and displaceable in a longitudinal direction of the rail into a mounted position engaged with an edge of the slot for removably securing the rail to the wall section.

2. The home appliance device according to claim 1, further comprising at least one damper for damping at least a vibration of the compressor with respect to the fixation unit.

3. The home appliance device according to claim 1, further comprising an evaporation tray which is arranged at least partly between the compressor and the fixation unit.

4. The home appliance device according to claim 3, wherein the compressor and the evaporation tray are connected to the fixation unit by a bent protrusion of the rail.

5. The home appliance device according to claim 4, further comprising a damper for damping at least a vibration of the compressor with respect to the fixation unit and a plate having a hole for receiving the bent protrusion, a free end of the bent protrusion being plastically deformable for fixing the plate to the rail.

6. A home appliance device, comprising:
a machine compartment having at least one wall section, the wall section having a bent-over edge with a hole formed therein;
a compressor which is arrangeable inside the machine compartment; and
a fixation unit for removably mounting the compressor to the wall section, the fixation unit including a rail attached to the compressor, the rail having an end face with an aperture formed therein;
a fastener insertable through the hole and the aperture for fixing the rail to the wall section.

7. The home appliance device according to claim 6, wherein the end face is defined by a bent over portion of the rail.

8. A home appliance device, comprising:
a machine compartment having at least one wall section;
a compressor which is arrangeable inside the machine compartment, the compressor having a foot;
a damper mating with the foot for mounting the compressor to the wall section;
an evaporation tray having a tubular wall projecting from a base surface thereof for defining a recess, the recess receiving the damper therein;
a rail secured to the compressor and the evaporation tray by the damper, the rail having a connector insertable in the damper for attaching the evaporation tray and compressor to the rail.

9. The home appliance device according to claim 8, wherein the foot has a foot aperture and the foot aperture receives an outer surface of the damper.

10. The home appliance device according to claim 8, wherein the tubular wall is at least as high as a perimeter wall of the evaporation tray.

11. The home appliance device according to claim 8, wherein the connector is a bent protrusion of the rail.

12. The home appliance device according to claim 11, further comprising a plate having a hole for receiving the bent protrusion, a free end of the bent protrusion being plastically deformable for fixing the plate against the damper.

* * * * *